US010116109B1

(12) United States Patent
Peng

(10) Patent No.: US 10,116,109 B1
(45) Date of Patent: Oct. 30, 2018

(54) THREADED LAMP SOCKET CONVERSION CONNECTOR

(71) Applicant: Te-Shui Peng, Taoyuan (TW)

(72) Inventor: Te-Shui Peng, Taoyuan (TW)

(73) Assignee: Rich Brand Industries Ltd., Dongguan, Guangdong (CN)

( * ) Notice: Subject to any disclaimer, the term of this patent is extended or adjusted under 35 U.S.C. 154(b) by 0 days.

(21) Appl. No.: 15/830,518

(22) Filed: Dec. 4, 2017

(51) Int. Cl.

| | |
|---|---|
| ***H01R 24/54*** | (2011.01) |
| ***H01R 31/06*** | (2006.01) |
| ***H01R 33/22*** | (2006.01) |
| ***H01R 27/02*** | (2006.01) |
| *H01R 33/94* | (2006.01) |
| *H01R 33/945* | (2006.01) |

(52) U.S. Cl.
CPC ..... *H01R 31/06* (2013.01); *H01R 27/02* (2013.01); *H01R 33/22* (2013.01); *H01R 24/54* (2013.01); *H01R 33/94* (2013.01); *H01R 33/9453* (2013.01)

(58) Field of Classification Search
CPC ..... H01R 24/54; H01R 31/06; H01R 33/94; H01R 33/9453; H01R 33/22
USPC ..... 439/638, 641, 667, 665
See application file for complete search history.

(56) References Cited

U.S. PATENT DOCUMENTS 7,387,544 B1 * 6/2008 Hsu ..... H01R 13/6397 439/300
7,407,418 B1 * 8/2008 Harlan ..... F21V 19/00 439/641

* cited by examiner

*Primary Examiner* — Abdullah A Riyami
*Assistant Examiner* — Justin M Kratt
(74) *Attorney, Agent, or Firm* — Jen-Feng Lee, Esq.

(57) ABSTRACT

Present invention disclosed a threaded lamp socket conversion connector, having the major parts of a metal shell, a metal contact point located at the top portion of said metal shell, an insulator surrounding the metal contact point, a plastic main body, a first terminal piece and a second terminal piece. By relying on the terminal pieces extending and connecting from the structure of a connection port, different power input sources pertaining to the newer generation energy-saving lights can be converted to the prevalent E26/E27 specification via the connection mechanism as disclosed in the present application.

7 Claims, 4 Drawing Sheets

THREADED LAMP SOCKET CONVERSION CONNECTOR

FIELD AND BACKGROUND OF THE INVENTION

The present invention relates to lamp products, particularly to a lamp socket that allows for the connection of newer lighting devices' electrical power supply to be converted into compatible way of installation sockets of the traditional light bulbs with a threaded circular external surface.

The recent trend of environmental awareness, cutting carbon emission, and reducing carbon footprint, etc., pushes the lighting industry to develop newer technology where energy-saving florescent lights, LED lights, or other new type of lights are replacing the traditional incandescent lights, whose lighting is based upon heating up the tungsten wire inside the bulbs.

However, the newer generation of energy-saving lights is not developed with a consistent or compatible power connection interface, such as the industry specification E26/E27 where the incandescent light bulbs use the circular external metal threaded pattern for connecting to a socket. Such E26/E27 light bulbs and sockets, due to the long history of use around the world, in fact pose an obstacle to the adoption of energy-saving lights due to the power connection interface that is different on many newer generation lights. To change all existing E26/E27 socket connection interface, countless numbers of them, is in fact a huge waste and not environmentally friendly. Consequently, the present invention is meant to illustrate a mechanism where the conversion socket is provided to allow newer energy-saving lights to be easily adapted and then connected to the older E26/E27 sockets when necessary, instead of a wholesale re-installation of the old socket interface as alluded to herein.

SUMMARY OF THE INVENTION

The invention relates to a threaded lamp socket conversion connector with the major parts of a metal shell, a metal contact point located at the top portion of said metal shell, an insulator surrounding the metal contact point, a plastic main body, a first terminal piece and a second terminal piece.

The metal shell is made of metal material appropriate for electrical conductivity, with circular outer threads formed along the outside surface. The circular outside threads are matching and compatible with those found on traditional E26/E27 light bulbs, achieving the conversion purpose stated herein.

The metal shell serves as an electrode (negative end, generally) and the metal contact point serves as another electrode (positive end, generally). The metal contact point is mounted on to the metal shell to a central location of the insulator, which is located at the top portion of the metal shell. There is electrical insulation between metal contact point and metal shell thanks to the insulator.

The plastic main body is sized to receive the metal shell, causing the metal shell to be fixedly attached to the cylindrical neck of the plastic main body.

The plastic main body has a flange-like edge protrusion, which has a diameter larger than the cylindrical neck and serves to wedge the metal shell in place. The edge protrusion has a teeth structure to provide anti-slip gripping for human operation.

Two terminal pieces, contacting the metal contact point and the metal shell respectively, form the positive and negative electrodes for the connector of the present application.

By relying on the terminal pieces extending and connecting from the structure of a connection port, different power input sources pertaining to the newer generation energy-saving lights can be converted to the prevalent E26/E27 specification via the connection mechanism as disclosed in the present application

DESCRIPTION OF THE DRAWINGS

The accompanying drawings, which are incorporated in and constitute a part of this specification, illustrate the preferred embodiments of the invention and together with the description, serve to explain the principles of the invention.

DETAILED DESCRIPTION OF THE PREFERRED EMBODIMENT

Figure 1:
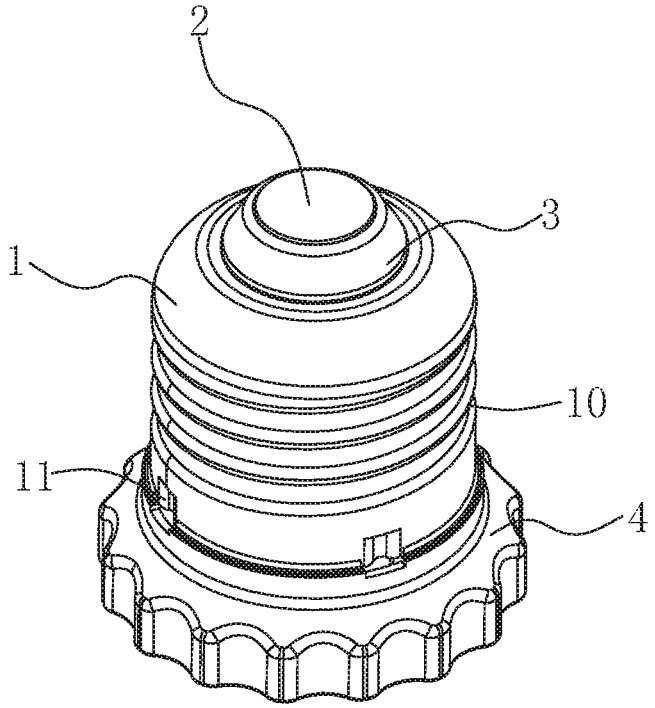
FIG. 1 is a main perspective view of present invention.

The technical characteristics, contents, advantages and effects of the present invention will be apparent with the detailed description of a preferred embodiment accompanied with related drawings as follows.

While the invention has been described by means of specific embodiments, numerous modifications and variations could be made thereto by those skilled in the art without departing from the scope and spirit of the invention set forth in the claims.

As shown in FIGS. 1-6, the threaded lamp socket conversion connector of present application has the following major parts: a metal shell 1, a metal contact point 2 located at the top portion of said metal shell 1, an insulator 3 surrounding the metal contact point 2, a plastic main body 4, a first terminal piece 5 and a second terminal piece 6.

The metal shell 1 is made of metal material appropriate for electrical conductivity, with circular outer threads 10 formed along the outside surface. The circular outside threads 10 are matching and compatible with those found on traditional light bulbs of the E26/E27 specification, thereby achieving the conversion purpose stated herein.

The metal shell 1 serves as an electrode (negative end, generally) and the metal contact point 2 serves as another electrode (positive end, generally). Certainly, in a AC-current environment, as is the case in most North American households where the electrical grid provides 110V AC current to most households (with 220V availability for limited range of appliances such as air-conditioners, heaters or certain cook tops), a lighting device's electrical polarity of being positive or negative, related to its power plug or other connection point, has no relevance.

The metal contact point 2 can be mounted on to the metal shell 1 using any mechanism, including traditional riveting method, to a central location of the insulator 3, which is located at the top portion of the metal shell 1. There is electrical insulation between metal contact point 2 and metal shell 1 on account of the insulator 3.

Figure 2:
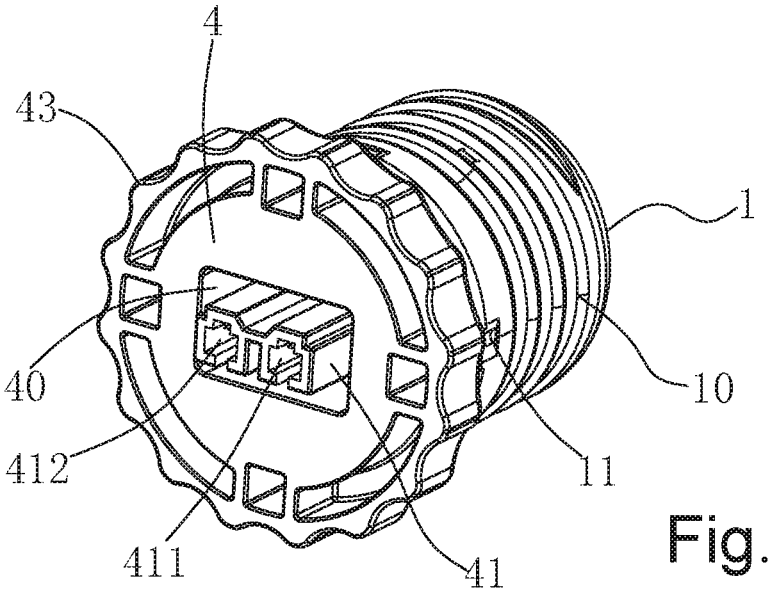
FIG. 2 is a perspective view of present invention from a different angle.
Figure 3:
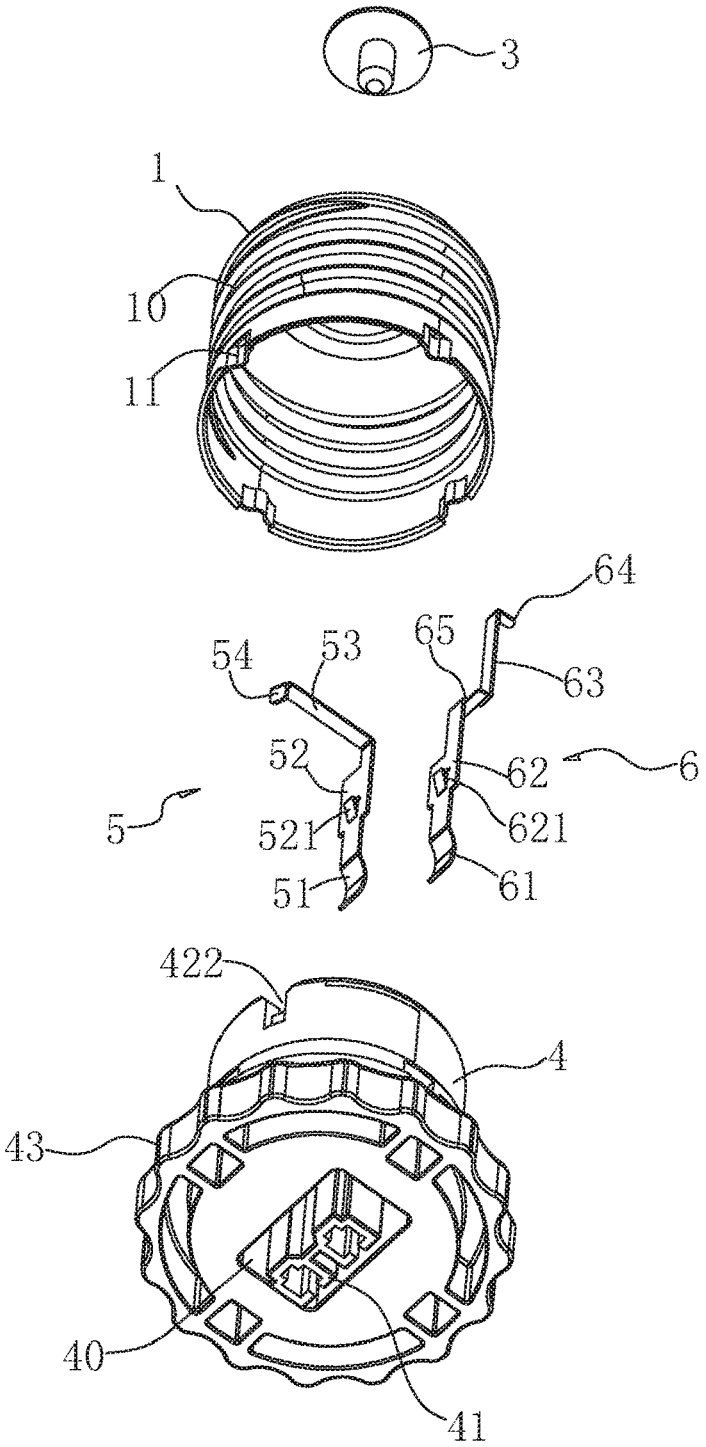
FIG. 3 is an exploded view showing the parts of present invention.

The plastic main body 4 is for receiving and attaching to the metal shell 1, as shown in FIG. 3. The plastic main body 4 has a cylindrical neck 42 sized to snugly receiving and fit into the inner side of metal shell 1, as shown in FIGS. 1 and 2. The plastic main body 4 has a flange-like edge protrusion 43, which has a diameter larger than the cylindrical neck 42 and serves to stop and wedge the metal shell 1 in place. The outside circumference of the edge protrusion 43 has a teeth structure, as shown in FIGS. 1 and 2, to provide anti-slip gripping for human operation.

Figure 5:
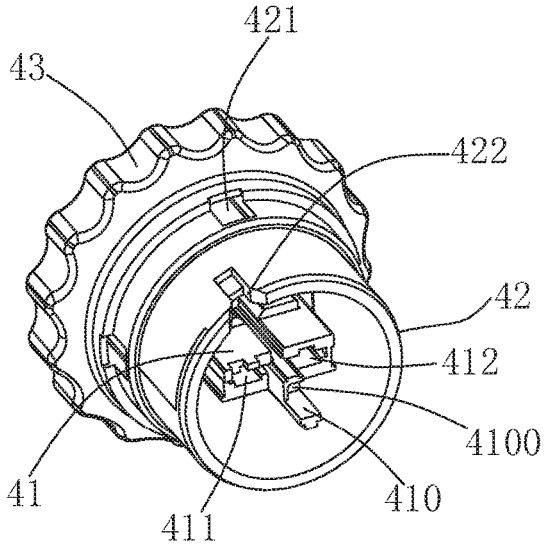
FIG. 5 is a perspective view of the plastic main body.

The metal shell 1 is fitted onto the cylindrical neck 42, and is secured to the cylindrical neck 42 via a plurality of locking tabs 11 at bottom portion of the metal shell 1 and a plurality of locking notches 421 located near the edge protrusion 43 of the cylindrical neck 42. The locking notches 421 serve to receive the matching locking tabs 11 of the metal shell 1, and securing the plastic main body 4 in place with the metal shell 1. FIGS. 3 and 5 show the locking tabs 11 and locking notches 421, before being assembled together, as shown in FIGS. 1 and 2.

Figure 4:
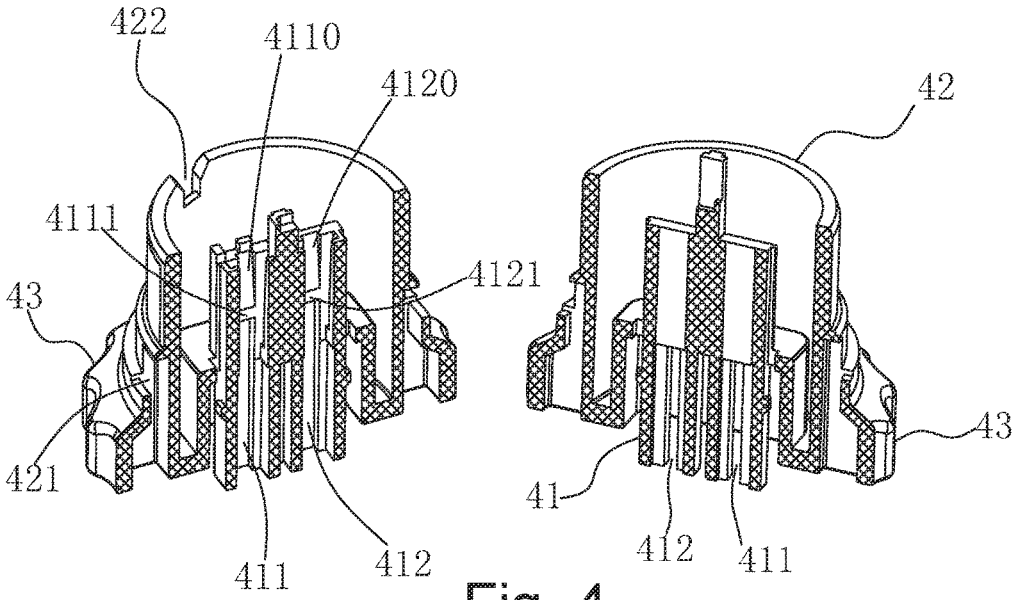
FIG. 4 is an internal view of the plastic main body, showing the two halves of the plastic main body, when cut vertically along a central plane.

A flat surface side of the plastic main body 4 contains an integrally formed connection port 40, as shown in FIG. 2, with the other side of the connection port 40 mechanism shown in FIGS. 4 and 5, with further explanation below.

A connection piece 41 is formed inside the connection port 40; said connection piece 41 extends into the chamber portion of the cylindrical neck 42, and forms a support post 410; the support post 410 further has a support seat 4100, as shown in FIG. 5.

Within the connection piece 41, a first channel 411 and a second channel 412 are formed to receive the first terminal piece 5 and the second terminal piece 6 respectively. The top end of said first terminal piece 5 is in contact with said metal shell 1, and the bottom end of said first terminal piece 5 is inserted into the first channel 411. The top end of said second terminal piece 6 is in contact with the metal contact point 2, and the bottom end of said second terminal piece 6 is inserted into the second channel 412.

The insertion of the two terminal pieces 5 and 6 into the two channels 411 and 412 forms the positive and negative electrodes for the connection piece 41, providing the converted power supply interface as intended by the present application.

Figure 6:
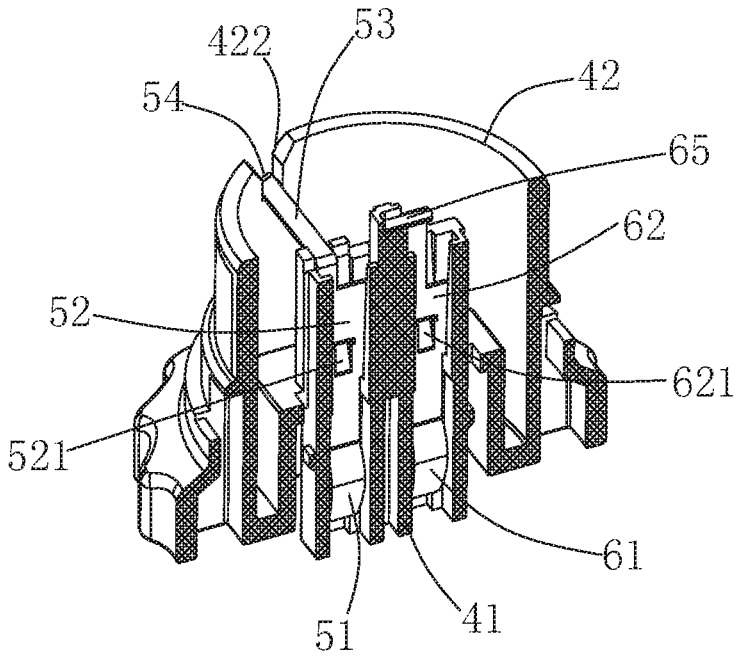
FIG. 6 is a cutout profile view of the plastic main body, showing the relevant parts of the first terminal piece and second terminal piece being assembled in place.

As sown in FIG. 3, the first terminal piece 5 is further integrally comprised of a first attaching segment 52, a first conducting segment 51, a first bend-out segment 53, and a first contact segment 54 at the end tip of the first bend-out segment 53. The first terminal piece 5 is inserted into the first channel 411, and the first bend-out segment 53 is protruding out from the cylindrical neck 42 from a contact notch 422 (as shown in FIG. 6 as well), so that the first contact segment 54 forms an electrical connection with the metal shell 1.

As shown in 3, the second terminal piece 6 is further integrally comprised of a second attaching segment 62, a second conducting segment 61, a second extending segment 63, and a second contact segment 64 at the end tip of the second extending segment 63. The second contact segment 64 forms an electrical connection with the metal contact point 2.

A first locking leaf 521 on the first attaching segment 52 will be received by a first guide slot 4110 of the first channel 411. Within the first guide slot 4110, a first partition 4111 is formed where the first locking leaf 521 will slide along the length direction of the first guide slot 4110 until it contacts and clicks to the first partition 4111, as shown in FIGS. 4 and 6, whereby the first locking leaf 521 is hooked on the point of the first partition 4111, preventing the first terminal piece 5 to be pulled out.

A second locking leaf 621 on the second attaching segment 62 will be received by a second guide slot 4120 of the second channel 412. The second guide slot 4120 receives the second locking leaf 621 at the ending tip of the second guide slot 4120. Within the second guide slot 4120, a second partition 4121 is formed where the second locking leaf 621 will slide along the length direction of the second guide slot 4120 until it contacts and clicks over on the second partition 4111, as shown in FIGS. 4 and 6, whereby the second locking leaf 621 is hooked on the point of the second partition 4121, preventing the second terminal piece 6 to be pulled out.

The connection piece 41 extends into the inner volume of the cylindrical neck 42, and forms a support post 410, with a support seat 4100.

The junction area of the second attaching segment 62 and the second extending segment 63 forms a twist joint 65 that is seated at the location of the support seat 4100. The second extending segment 63 is sticking to the support post 410, and extends away from the second guide slot 4120 of the second channel 412, so that the second contact segment 64 will be in contact with the metal contact point 2, resulting in a stable electrical connection being made.

As can be seen, connection port 40 and the connection piece 41 can be configured to fit any different technical specification of any current or new style of energy-saving light while the old and existing circular thread socket connection for installing the new energy-saving lights can easily be adapted for use by the mechanism of the present application.

The specification, the drawings and the claims disclosed herein are preferred embodiments of the invention and together with the description, serve to explain the principles of the invention, which are not to be interpreted as to limit scope of invention enabled by the disclosure herein.

The invention claimed is:

1. A threaded lamp socket conversion connector, comprising, a metal shell having a metal contact point at top portion of said metal shell, an insulator surrounding the metal contact point, said metal shell further having a plurality of locking tabs at its bottom portion, said metal shell has circular outer threads along the outside surface, a first terminal piece and a second terminal piece, and a plastic main body for receiving and attaching to said metal shell and having a connection piece situated inside a connection port, said plastic main body further having a flange-like edge protrusion, wherein the top end of the first terminal piece is in contact with said metal shell and the bottom end of said first terminal piece is inserted into the connection piece, and wherein the top end of the second terminal piece is in contact with the metal contact point, and the bottom end of said second terminal piece is inserted into the connection piece, the first terminal piece and the second terminal piece forming the positive and negative electrodes for the conversion lamp socket connector; and wherein the plastic main body further comprises a cylindrical neck sized to snugly fit into the metal shell, said cylindrical neck further having a plurality of locking notches located near the edge protrusion, whereby said locking notches serve to receive the matching locking tabs of the metal shell and securing the plastic main body together with the metal shell.

2. The threaded lamp socket conversion connector of claim 1, wherein the connection piece further comprises a first channel and a second channel for the insertion of the first terminal piece and second terminal piece respectively.

3. The threaded lamp socket conversion connector of claim 2, wherein the first terminal piece further comprises a first attaching segment, a first conducting segment, a first bend-out segment, and a first contact segment at the end tip of said first bend-out segment, wherein the first terminal piece is inserted into the first channel, wherein the first bend-out segment is protruding out from the cylindrical neck from a contact notch, whereby the first contact segment forms an electrical connection with the metal shell.

4. The threaded lamp socket conversion connector of claim 3, wherein the first attaching segment further having a first locking leaf, and the first channel further having a first guide slot and a first partition for receiving the first locking leaf, wherein the first locking leaf will slide along the length direction of the first guide slot until it contacts and clicks to the first partition and the first locking leaf is hooked on the point of the first partition.

5. The threaded lamp socket conversion connector of claim 2, wherein the second terminal piece further comprises a second conducting segment, a second extending segment, and a second contact segment at the end tip of the second extending segment, whereby the second contact segment forms an electrical connection with the metal contact point.

6. The threaded lamp socket conversion connector of claim 5, wherein the second attachment segment further having a second locking leaf, and the second channel further having a second guide slot for receiving the second locking leaf at the ending tip of the second guide slot, and resting on a second partition.

7. The threaded lamp socket conversion connector of claim 6, wherein the connection piece further extends into the inner volume of the cylindrical neck to form a support post with a support seat, wherein the junction area of the second attaching segment and the second extending segment form a twist joint that is seated at the location of the support seat.

* * * * *